US009145647B2

(12) United States Patent
Mueller et al.

(10) Patent No.: US 9,145,647 B2
(45) Date of Patent: Sep. 29, 2015

(54) FOLDING SWITCH

(75) Inventors: Hans-Dieter Mueller, Bochum (DE); Ronald Schlufter, Frankfurt am Main (DE)

(73) Assignees: Rail.One GmbH, Neumarkt (DE); DB Netz AG, Frankfurt (DE)

( * ) Notice: Subject to any disclaimer, the term of this patent is extended or adjusted under 35 U.S.C. 154(b) by 80 days.

(21) Appl. No.: 13/816,535

(22) PCT Filed: Jul. 12, 2011

(86) PCT No.: PCT/EP2011/003465

§ 371 (c)(1),
(2), (4) Date: Feb. 12, 2013

(87) PCT Pub. No.: WO2012/025170

PCT Pub. Date: Mar. 1, 2012

(65) Prior Publication Data

US 2013/0140406 A1 Jun. 6, 2013

(30) Foreign Application Priority Data

Aug. 27, 2010 (DE) ..... 10 2010 035 675

(51) Int. Cl.
*E01B 29/02* (2006.01)
*E01B 7/22* (2006.01)

(52) U.S. Cl.
CPC . *E01B 29/02* (2013.01); *E01B 7/22* (2013.01); *Y10T 29/49764* (2015.01)

(58) Field of Classification Search
CPC ..... E01B 29/02; E01B 7/22
USPC ..... 246/415 R, 435 R; 238/25, 27, 31, 32, 238/33, 83, 84, 85, 104
See application file for complete search history.

(56) References Cited

U.S. PATENT DOCUMENTS

| | | | | | |
|---|---|---|---|---|---|
| 312,881 | A | * | 2/1885 | McVey | 238/32 |
| 995,385 | A | * | 6/1911 | Stephenson | 238/32 |
| 1,070,411 | A | * | 8/1913 | Clark, Jr. | 238/32 |
| 1,162,326 | A | * | 11/1915 | Light | 238/32 |
| 1,164,536 | A | * | 12/1915 | Yates | 238/32 |
| 1,349,171 | A | * | 8/1920 | Spencer | 238/32 |
| 4,802,623 | A | | 2/1989 | Fasterding et al. | |

(Continued)

FOREIGN PATENT DOCUMENTS

| | | | |
|---|---|---|---|
| DE | 199 48 003 | A1 | 4/2001 |
| DE | 10 2004 063 636 | A1 | 7/2006 |

(Continued)

OTHER PUBLICATIONS

International Search Report of PCT/EP2011/003465, Nov. 29, 2011.

*Primary Examiner* — Zachary Kuhfuss
(74) *Attorney, Agent, or Firm* — Collard & Roe, P.C.

(57) ABSTRACT

The invention relates to a switch and to a method for transporting and installing such a switch, which is equipped with longitudinal sleepers, the sleeper sections (2, 3) of which are or can be coupled in a flexurally stiff manner by means of a connecting device (16) embedded in the sleeper heads (4) so that the switch can be folded for space-saving transport. The divided longitudinal sleepers are oriented relative to each other and installed in such a way that the joints of the longitudinal sleepers are aligned along a straight line, which thus can serve as a rotational axis for folding up a side of the switch. The joints aligned on the rotational axis act similarly to a hinge band so that complete switch segments, such as a switch end part or the core region, can be folded along the line.

11 Claims, 6 Drawing Sheets

(56) References Cited

U.S. PATENT DOCUMENTS

| | | | |
|---|---|---|---|
| 6,070,806 | A | 6/2000 | Barbakadze et al. |
| 7,556,208 | B1 | 7/2009 | Reichel |
| 2008/0105757 | A1 | 5/2008 | Freudenstein |
| 2009/0064610 | A1 | 3/2009 | Ahn |
| 2012/0181343 | A1 | 7/2012 | Schimpff et al. |

FOREIGN PATENT DOCUMENTS

| | | | |
|---|---|---|---|
| DE | 10 2009 049 411 | A1 | 4/2011 |
| EP | 0 249 574 | B1 | 1/1991 |
| EP | 0 552 788 | | 7/1993 |
| EP | 0 552 788 | B1 | 12/1996 |
| EP | 0 812 959 | | 12/1997 |
| EP | 1 026 321 | | 8/2000 |
| EP | 1 026 321 | B1 | 8/2005 |
| EP | 1 908 880 | | 4/2008 |
| JP | 2004-232233 | A | 8/2004 |
| JP | 2008 031653 | A | 2/2008 |
| SU | 562 608 | | 6/1977 |
| WO | 2005/100691 | A1 | 10/2005 |
| WO | WO 2006/064216 | | 6/2006 |
| WO | WO 2011/045018 | | 4/2011 |

* cited by examiner

FOLDING SWITCH

CROSS REFERENCE TO RELATED APPLICATIONS

This application is the National Stage of PCT/EP2011/003465filed on Jul. 12, 2011, which claims priority under 35 U.S.C. §119 of German Application No. 10 2010 035 675.1 filed on Aug. 27, 2010, the disclosures of which are incorporated by reference. The international application under PCT article 21(2) was not published in English.

The invention pertains to a switch that is equipped with longitudinal sleepers, the sleeper sections of which are or can be coupled in a flexurally rigid fashion by means of a connecting device embedded in the sleeper heads such that the switch can be folded for space-saving transport, as well as to a method for transporting and for installing such a switch.

Switches consist of several segments that in accordance with the standard joints defined by the welding points are divided into switch device
center part
crossing area
switch end part.

The switch segments forming the crossing area, the switch end part and the switch connections, in particular, represent large components, the transport and installation of which is quite elaborate.

As a rule, switches are assembled of separately delivered concrete sleepers, the switch track (switching device, crossing, rails, check rails) and mounting components at the intended installation site. Since switches are sometimes completely preassembled for control purposes at the manufacturing facility due to the required high accuracy, this approach is particularly labor-intensive because the completely preassembled switch needs to be once again disassembled and subsequently transported to the installation site. In addition, the preassembly of switches in the construction area is problematic for different reasons. Consequently, it was already proposed to transport preassembled switches to the installation site and to install the switches in this state. However, such switches exceed the size of available railway cars such that costly special cars (switch transport cars) are required for the transport. According to an alternative approach, it is proposed to divide preassembled switches for their transport. The assembly and installation of the switches subsequently takes place at the installation site.

EP 1 026 321 A1 discloses a connecting device of steel for railroad switches, by means of which prefabricated sleeper sections of prestressed concrete can be subsequently connected into sleeper units in a flexurally rigid, tension-proof and shear-proof fashion such that the switch can be evenly and systematically installed during the assembly. Connecting devices of steel are embedded in the region of the sleeper heads of the individual sleeper sections of a prestressed concrete sleeper, wherein these connecting devices protrude from the end faces of the sleeper sections and end in webs that can be bolted together by means of bolt connections.

An alternative design of a flexurally rigid connecting device for concrete sleepers is known from EP 1 908 880 A1. In this publication, it is proposed to tension head plates of steel against the end faces of the concrete to both sides of the butt joint and to connect these head plates by means of steel clamps. However, such connecting devices have the disadvantage of being relatively complicated and therefore costly such that it remains questionable whether their utilization is economical.

The invention therefore is based on the objective of making available a switch that can be folded for space-saving transport. The invention furthermore aims to make available a method for transporting and for installing a switch.

In order to attain this objective, the invention proposes to equip the switch with longitudinal sleepers, the sleeper sections of which are or can be coupled in a flexurally rigid fashion by means of a connecting device embedded in the sleeper heads. In this case, the connecting device may simultaneously fulfill a hinge function. The divided longitudinal sleepers are furthermore oriented relative to one another and assembled in such a way that the hinges are aligned along a straight line that therefore can serve as pivoting axis for folding up one switch side. The hinges aligned along the pivoting axis act similar to a strap hinge such that complete switch segments such as, e.g., a switch end part or the crossing area can be folded along this line. This reduces the supporting surface for the switch on the transport means required for transporting the switch.

Due to this arrangement, the running rails, the check rails and other switch components can also remain on the completely assembled switch segment during the transport.

The inventive device allows an economical transport of large switch components on standard freight cars and also simplifies the installation, as well as the loading and unloading at the switch manufacturing facility and at the construction site. This significantly reduces the expenditure of time.

The invention can also be utilized analogously for crossings or other large-surface track segments that are equipped with sleepers.

In an advantageous embodiment of the invention, the connecting device is realized in the form of a bolt connection with at least two bolts. Web plates are arranged on the respective head ends of the sleeper section heads to be connected to one another, wherein said web plates are oriented parallel to one another in the unfolded installation state of the switch and offset relative to one another such that they flatly abut. The contact surface should extend perpendicular to the pivoting axis, along which the connecting devices are aligned in accordance with the invention. Common bores serve for fixing the web plates on one another with the aid of bolts such that a flexurally rigid connection is produced when the bolts are tightened. If all bolts but one are removed and the remaining bolt is loosened, the web plates are able to turn relative to one another about the remaining bolt. The connection acts as a hinge in this case.

It would also be possible to respectively arrange several parallel web plates on the head ends without deviating from the invention.

It is furthermore advantageous to realize the connecting device in such a way that the web plates have a fixed limit stop referred to the pivoting motion about the hinge axis. This means that both web plates abut on the respectively opposing head pieces in a defined fashion in the unfolded state of the switch. If both web plates are jointly drilled and reamed during this defined abutment in the unfolded state, it is ensured that the bolts removed for folding the switch can also be reinstalled a precisely fitted fashion after it has been folded back.

It is advantageous to use fitting bolts for connecting the web plates in order to improve the accuracy of the alignment of the switch parts after folding.

In the region that borders on the connecting device, the sleeper sections advantageously consist of concrete with greater strength than the concrete in the remaining region. Unlike conventional prestressed concrete sleepers, the invention is based on the realization that the required superior mechanical properties of the prestressed concrete sleeper can, in contrast to, for example, the utilization of additional concrete steel or the like, also be achieved by choosing concrete with improved properties. The invention therefore proposes that this region consists of concrete with greater strength that compensates the prestress slowly building up in the application area of the prestressing force. The utilization of concrete with greater strength is limited to the region bordering on the connecting device in this case, wherein conventional concrete can be used adjacent thereto.

In the inventive prestressed concrete sleeper, it is particularly preferred that the concrete with greater strength consists of high-performance or ultra high-performance concrete (UHPC/UHFB). Concrete of this type not only has a high compressive strength, but also a high tensile strength such that ultra high-performance concrete is in the present instance particularly well suited for compensating the lacking prestress. The ultra high-performance concrete used in the inventive prestressed concrete sleeper may have a tensile strength of at least 10 MPa, preferably at least 20 MPa.

The tensile strength can be further increased if the high-performance or ultra high-performance concrete of the inventive prestressed concrete sleeper contains fibers. Steel fibers, plastic fibers, glass fibers or carbon fibers, in particular, may be considered in this respect. The aforementioned fibers may also be combined with one another in different compositions.

The scope of the invention also includes embodiments, in which the concrete with greater strength of the inventive prestressed concrete sleeper consist of concrete polymer. Concrete polymer is also referred to as resin-bonded concrete and likewise has a high tensile strength in comparison with normal concrete such that the loads occurring in the region of a connecting device of the prestressed concrete sleeper can also be absorbed when concrete polymer is used.

An additional reinforcement of the inventive prestressed concrete sleeper can be achieved by respectively arranging at least one the binder of concrete steel in the sleeper heads. This binder makes it possible to further increase the bearable forces and moments such that the required load bearing capacities are also achieved in the critical coupling region between two sleeper sections.

The transport of preassembled switches can be simplified by folding up or folding over the switches.

After the switches have been folded over, they can be transported to the intended installation site with a conventional freight car.

The invention therefore also pertains to a method for transporting and installing a switch with hinged longitudinal sleepers of the above-described type.

The inventive method comprises the following steps: complete preassembly of the large switch component of switch segments such as the crossing area and the switch end part and of all components such as rails, check rails, crossing and mounting material on the divided longitudinal sleepers that are connected with flexurally rigid connecting devices; quality check and acceptance of the large switch component; removing part of the bolts in the connecting devices such that only the bolts of the connecting devices remain that when loosened serve as hinge joints along the pivoting axis; folding and securing the movable part of the switch by means of a suitable transport securing mechanism; loading and transporting the large switch component to the installation site; removing the transport securing mechanism and unfolding the movable part of the switch back into its original position; installing all bolts removed for the transport and tightening all bolts. The switch is subsequently unloaded from the transport means and installed into the track.

When transporting a large switch component that is folded in accordance with the invention, it may occur that the center of gravity of the load is situated in a region that lies outside the tolerance of the transport means used, e.g. a standard railway car. This is the reason why the large switch component is advantageously transported on a car, on which the side wall flaps can be removed. In this case, the large switch component is in the folded state positioned on the car such that the center of gravity of the load lies in the permissible range around the center of the car, wherein the load exceeds the permissible clearance gauge for the respective track section on the non-folded side of the switch. The out-of-gauge large switch component can be transported in the form of a special transport in this case.

Alternatively, the folded large switch component can also be transported on another standard car such that the clearance gauge limits are observed, namely by positioning the large switch component in such a way that the normal clearance gauge is not exceeded. In order to compensate the impermissible center of gravity of the load in this case, counterweights are placed onto the non-folded side of the large switch component until the center of gravity of the load is shifted into the permissible range around the center of the car.

Other advantages and details of the invention are described below with reference to exemplary embodiments that are illustrated in the drawings. In these schematic drawings.

Figure 7A:
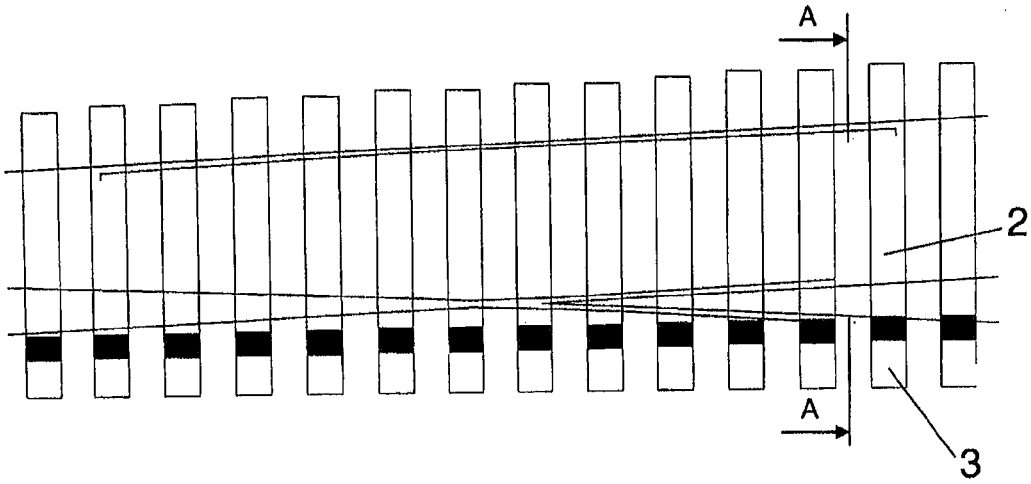
Figure 7B:
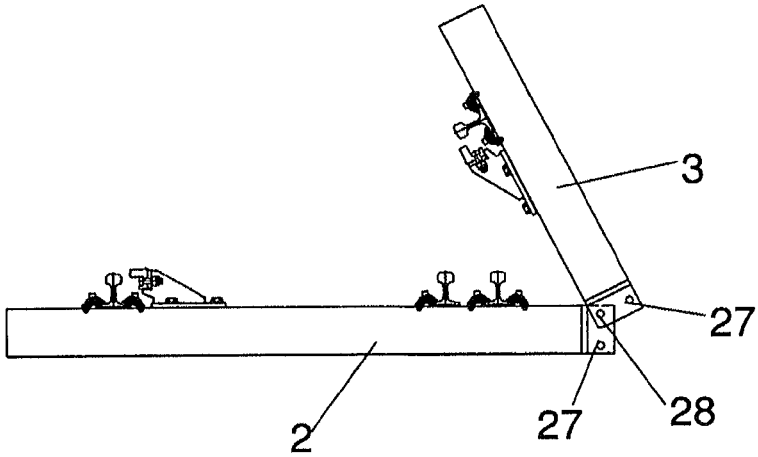
Figure 8B:
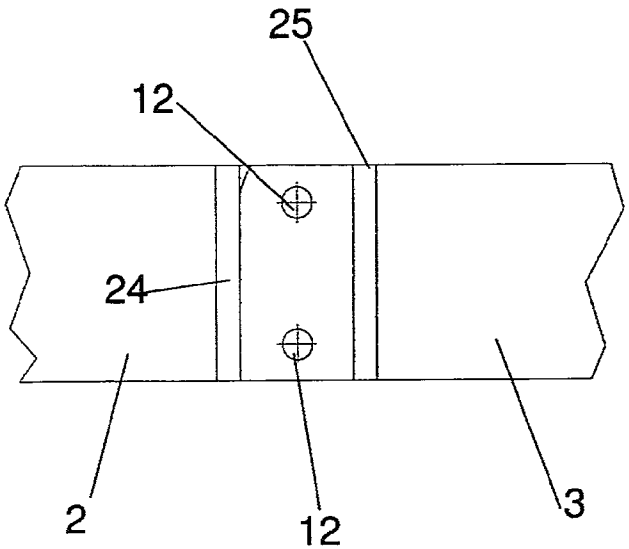
Figure 8A:
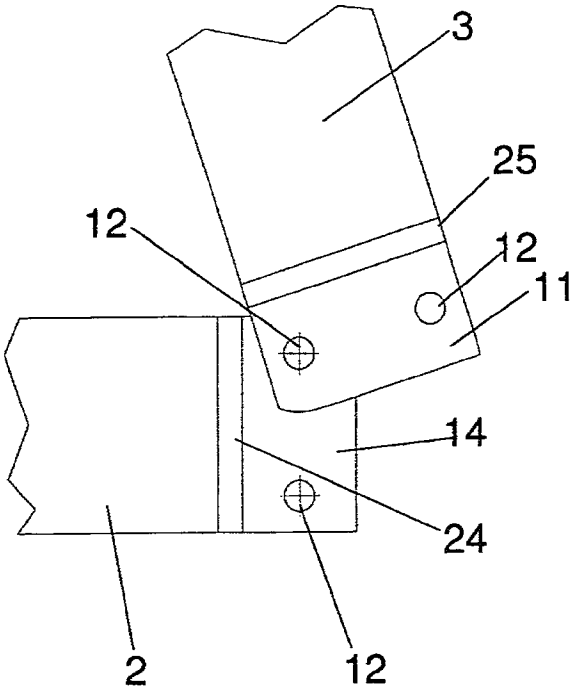

FIG. 7 shows the crossing area of a single turn-out switch in the folded state, namely in the form of a top view (FIG. 7 *a*) and in the form of a section A-A (FIG. 7 *b*), and FIG. 8 shows the fixed limit stops for the web plates on the respective opposite head pieces of the corresponding longitudinal sleeper sections, namely in the folded state (FIG. 8 *a*) and in the unfolded state (FIG. 8 *b*) of the sleepers. These limit stops serve for fixing the position of the lower bores when the switch is returned into the unfolded state.

Figure 1:
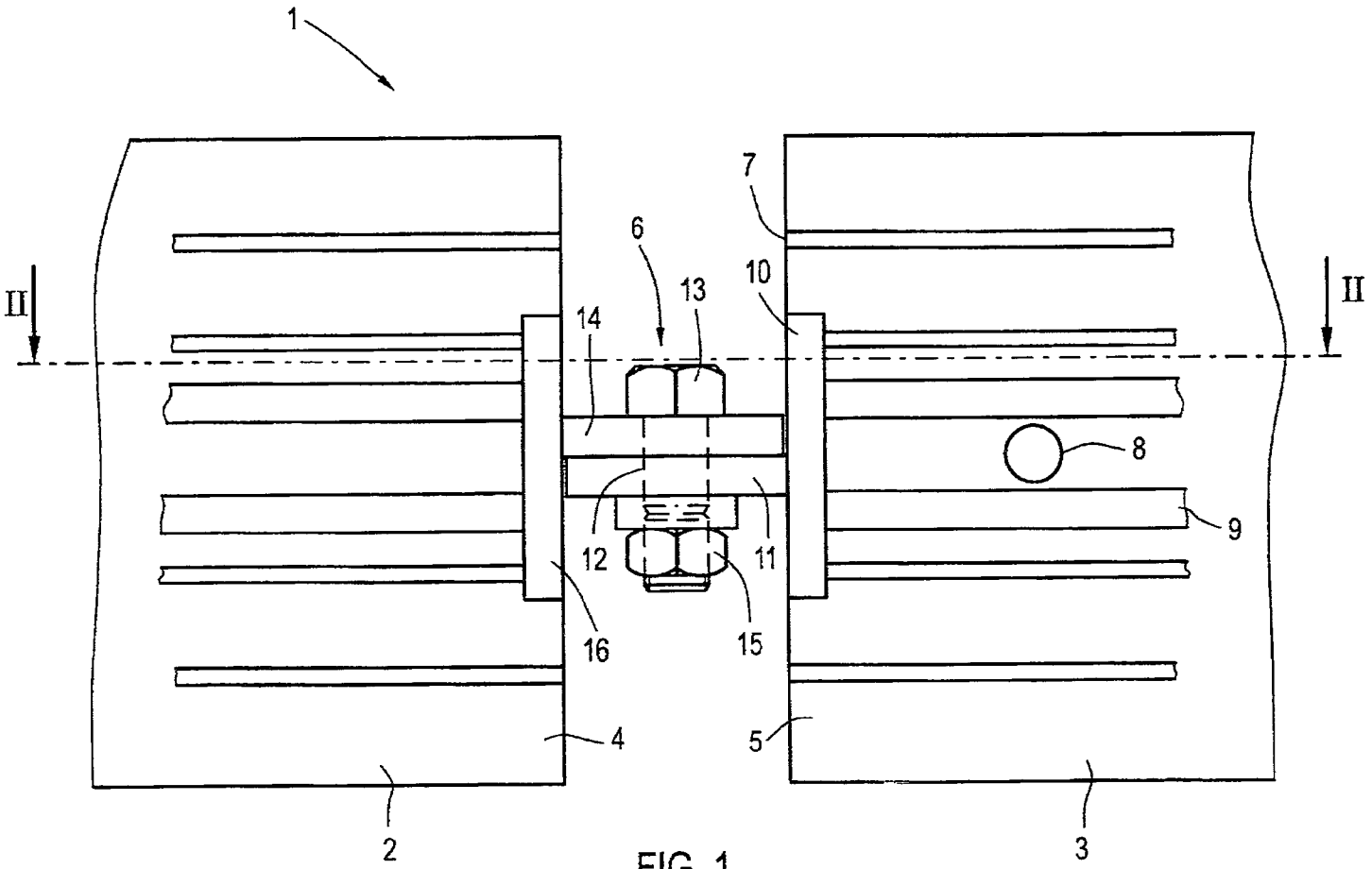
FIG. 1 shows an enlarged detail of an inventive prestressed concrete sleeper in the region of the coupling between two sleeper sections in the form of a top view.

FIG. 1 shows a top view of an exemplary embodiment of a prestressed concrete sleeper 1 with sleeper sections 2, 3 that are coupled in a flexurally rigid fashion by means of a connecting device 6 embedded in the sleeper heads 4, 5.

Each sleeper section 2, 3 features a plurality of tension wires 7, by means of which the sleeper sections 2, 3 are acted upon with a prestressing force in the form of a compressive force. The installation of the rails is realized with through-holes, of which only one through-hole 8 is illustrated in the sleeper section 3 in order to simplify the drawing.

In the exemplary embodiment shown, the welded connecting device 6 of steel respectively comprises four steel rods 9 that are arranged in the longitudinal direction of the prestressed concrete sleeper 1 and welded to a head plate 10. The head plate 10 ends flush with the outer side of the sleeper section 2, 3. Alternatively, it would also be conceivable to utilize a connecting device 6 in the form of a forging or casting, respectively.

A web 11 is welded to the outer side of the head plate and features a through-hole 12, into which a mounting bolt 13 can be inserted. The web 14 features two through-holes 12 as illustrated most clearly in FIG. 2. The head plate 16 embedded in the sleeper section 2 has a symmetric design and only the position of the web 14 is shifted accordingly. After a nut 15 is respectively tightened on the two mounting bolts 13, the sleeper sections 2, 3 of the prestressed concrete sleeper 1 are coupled to one another in a flexurally rigid fashion. A hinge is formed if one of the two bolt connections is completely removed and the bolt connection formed by the remaining mounting bolt 13 and the corresponding nut 15 is loosened, wherein the longitudinal axis of the mounting bolt 13 forms the pivoting axis of said hinge, about which the sleeper sections 2, 3 can be pivoted, such that the prestressed concrete sleeper 1 can be entirely or partially folded over or folded up in order to simplify its transport.

Figure 2:
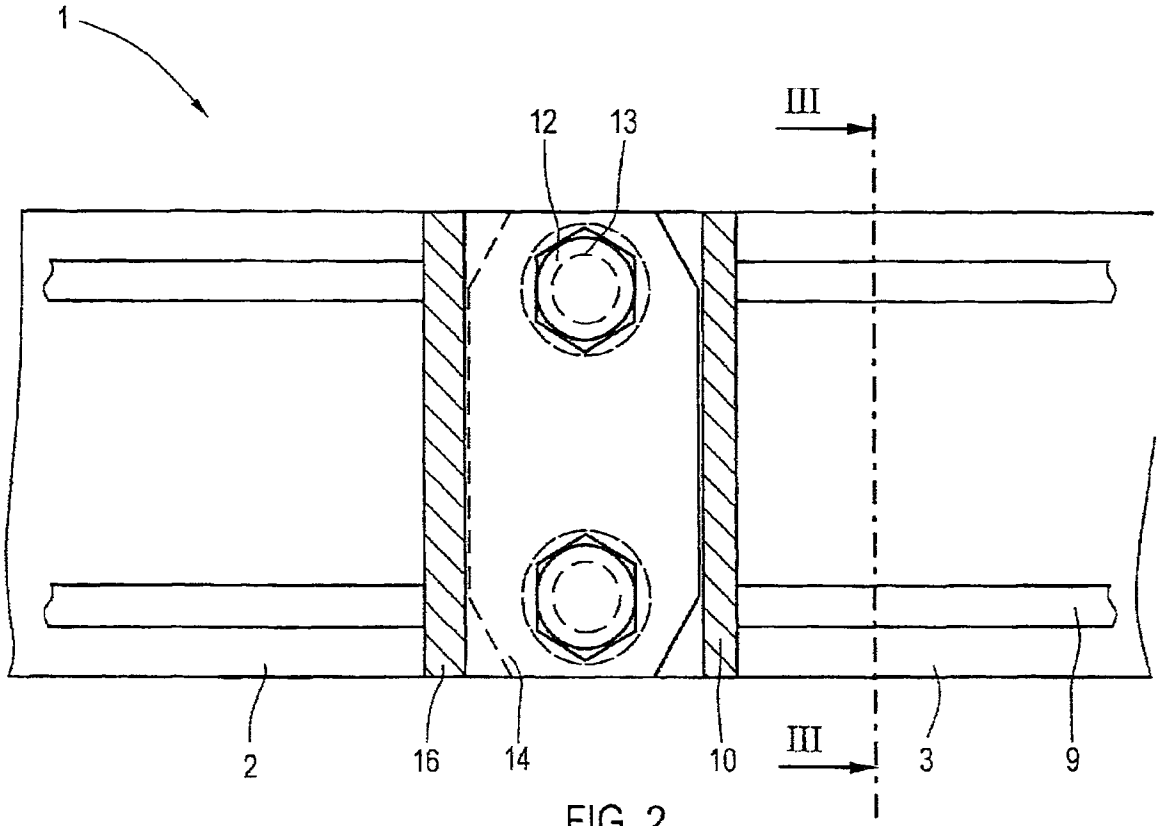
FIG. 2 shows a side view of the prestressed concrete sleeper according to FIG. 1 that is sectioned along the line II-II.

The side view according to FIG. 2 shows that the front web 14 welded to the left head plate 16 abuts on the right head plate 10 in FIG. 2 in a virtually planar fashion such that the flexurally rigid coupling of the sleeper sections 2, 3 is achieved.

Figure 3:
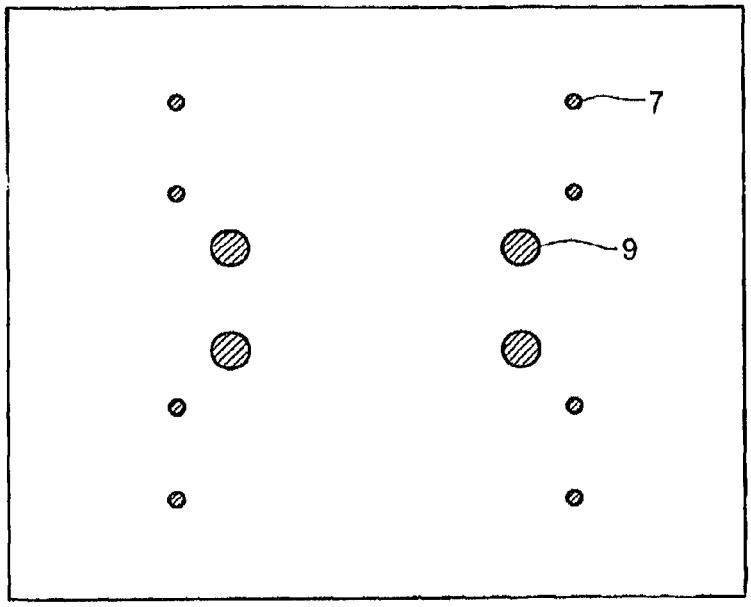
FIG. 3 shows a section through the prestressed concrete sleeper according to FIG. 2 along the line III-III.

FIG. 3 shows a section along the line in FIG. 2 and indicates the position of the tension wires 7 and the steel rods 9. However, this drawing should merely be interpreted in an exemplary fashion because the number and the position of the tension wires and the steel rods are chosen in dependence on the respective application.

Figure 4:
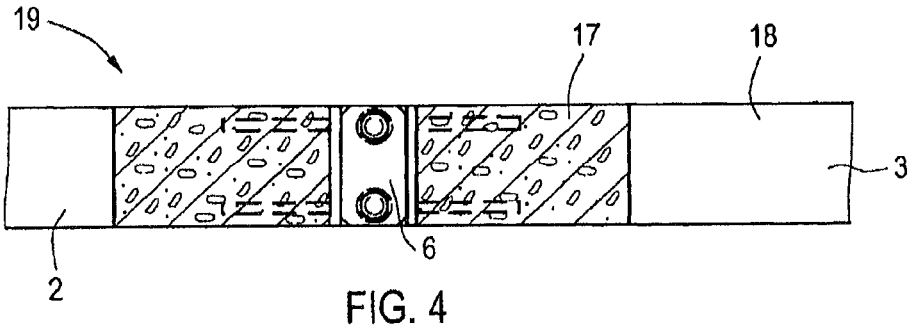
FIG. 4 shows a detail of an inventive prestressed concrete sleeper in the form of a side view.

FIG. 4 schematically shows the coupling area between two sleeper sections 2, 3 of a prestressed concrete sleeper 19. Tension wires are not illustrated in FIG. 4 in order to provide a better overview. In the region of the connecting device 6 and in a specified region beyond this connecting device, the sleeper sections 2, 3 consist of high-performance or ultra high-performance concrete 17 that has greater strength than the concrete 18 in the remaining region that consists of standard concrete. The high-performance or ultra high-performance concrete is reinforced with steel fibers. The high-performance or ultra high-performance concrete 17 compensates the reduced tensile strength occurring in the region of the sleeper heads because the prestress generated by the tension wires is not yet or not yet sufficiently built up at this location. Due to the high-performance or ultra high-performance concrete 17, the prestressed concrete sleeper 17 has a sufficient strength in this region such that the occurring loads can be reliably supported. The ultra-high-performance concrete 17 illustrated in FIG. 4 has a tensile strength of 20 MPa.

Figure 5:
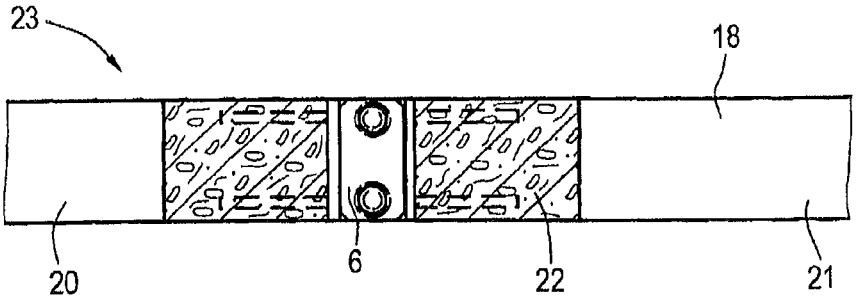
FIG. 5 shows another exemplary embodiment of an inventive prestressed concrete sleeper in the form of a side view.

FIG. 5 shows another exemplary embodiment of a prestressed concrete sleeper 23 in the region of the coupling between two sleeper sections 20, 21. The basic design corresponds to that illustrated in FIG. 4, wherein the prestressed concrete sleeper illustrated in FIG. 5 also features, in particular, the connecting device 6. In contrast to the preceding exemplary embodiments, the sleeper sections 20, 21 consist of concrete polymer 22 in the region bordering on the connecting device 6. The prestressed concrete sleeper consists of normal concrete 18 adjacent to the concrete polymer 22.

Figure 6A:
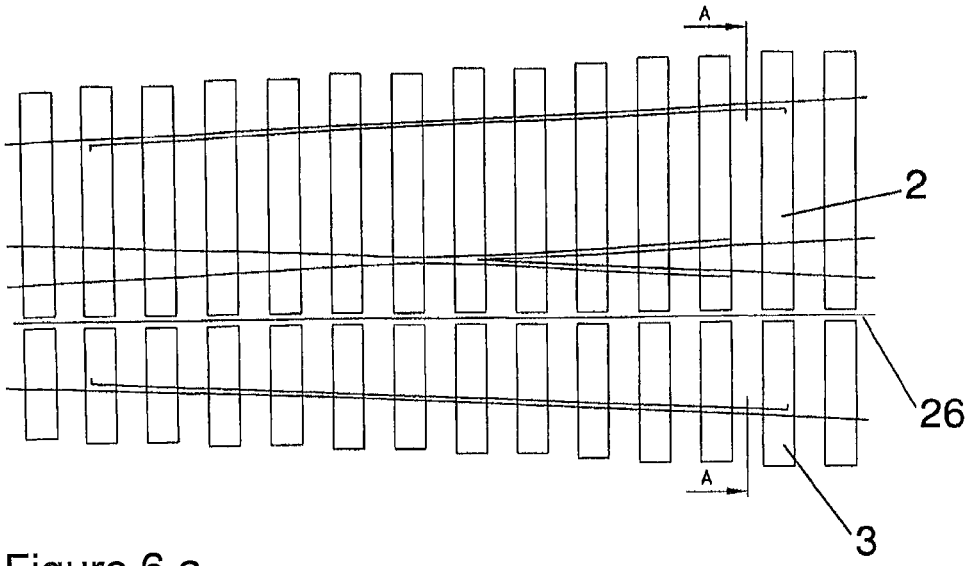
FIG. 6 shows the crossing area of a single turn-out switch in the unfolded state, in which the hinges of the connecting devices between the corresponding longitudinal sleeper sections are aligned along a straight line, namely in the form of a top view (FIG. 6 *a*) and in the form of a section A-A (FIG. 6 *b*)
Figure 6B:
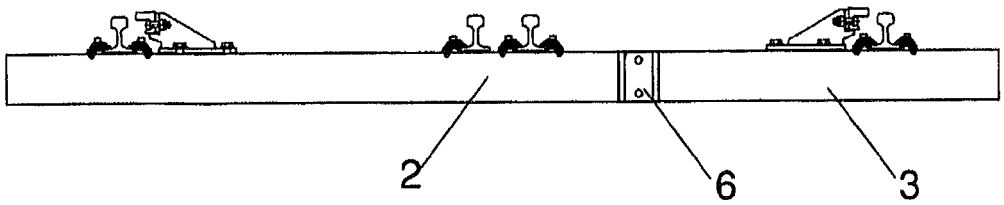

FIG. 6 shows an exemplary application of an inventive large switch component in the unfolded state. In this case, the longitudinal sleepers are divided into sections in such a way that the connecting elements 6 between the corresponding longitudinal sleeper sections are aligned along a straight line 26 that subsequently defines the pivoting axis for folding the switch. According to FIG. 8 *b*), the longitudinal sleeper sections 2 and 3 are in the installation state, i.e., in the unfolded state, positioned relative to one another in such a way that the web plate 14 of the sleeper section 2 abuts in a defined fashion on the limit stop 25 of the opposite head end of the sleeper section 3 and the web plate 11 of the sleeper section 3 abuts in a defined fashion on the limit stop 24 of the opposite head end of the sleeper section 2. Common bores are then produced in the web plates 11 and 14 that abut one another in parallel, namely in the direction of the pivoting axis, and the bores 12 are subsequently reamed. At least one other subsequently reamed common bore 12 is required per connecting device in order to realize a flexurally rigid connection. The rails, check rails and other switch components are installed after the corresponding web plates of all divided longitudinal sleepers were connected to one another in a flexurally rigid fashion by means of fitting bolts inserted into the bores. The quality check and the acceptance of the large switch component now take place.

FIG. 7 shows in an exemplary fashion how sections of the switch are folded over in order to observe the available transport space, e.g., of freight cars. The sleeper sections 3 coupled to the sleeper sections 2 are raised after removing bolt connections 27 that do not form the pivoting axis and loosening the bolt connection 28 that forms the pivoting axis. Once the switch is folded up, it can be transported on normal freight cars. During the transport of the folded switch, the center of gravity of the load is situated in an area that lies outside the tolerance of the freight cars used. The folded switch therefore needs to be positioned, e.g., on a Klps-car with removed side wall flaps in such a way that the center of gravity of the load lies within the permissible range around the center of the car. Since the load now exceeds the permissible clearance gauge for the respective track section on the non-folded side of the switch, the switch is transported to the installation site in the form of an out-of-gauge shipment.

At the installation site of the switch, the folded sections of the switch sleepers are once again unfolded into the nominal position, the removed bolts are reinserted and all bolts are tightened such that the respective sleeper sections are once again connected to one another in a flexurally rigid fashion. The switch can now be installed into the track.

This approach ensures that the geometry of the switch produced at the switch manufacturing facility is also maintained in a precisely fitting fashion after the installation into the track.

The invention claimed is:

1. A switch, the sleepers of which at least partially consist of several divided longitudinal sleepers that respectively consist of at least two sleeper sections that respectively are or can be coupled in a flexurally rigid fashion by means of a connecting device embedded in the sleeper heads, wherein the connecting device simultaneously has a hinge function, wherein hinges are oriented and installed in such a way that the hinges are aligned along a straight line that can serve as a pivoting axis for folding up one switch side.

2. The switch according to claim 1, wherein the connecting device is realized in the form of a bolt connection with at least two bolts, wherein the bolts connect parallel web plates that are respectively arranged on the head end of the sleeper section heads to be connected to one another in such a way that the flexurally rigid connection is produced when the bolts are tightened and, when loosening one bolt and removing the remaining bolts, the web plates are able to pivot relative to one another about the remaining bolt such that the connection acts as a hinge.

3. The switch according to claim 2, wherein the connecting device is realized in such a way that the web plates have a fixed limit stop referring to the pivoting motion about the hinge axes.

4. The switch according to claim 2, wherein the connecting device is realized in such a way that fitting bolts connect the web plates to one another.

5. The switch according to claim 1, wherein the sleepers consist of prestressed concrete sleepers that in a region bordering on the connecting device respectively consist of concrete with greater strength than concrete in a remaining region.

6. The switch according to claim 5, wherein the concrete with greater strength consists of concrete polymer.

7. The switch according to claim 5, wherein the concrete with greater strength consists of high-performance or ultra high-performance concrete (UHPC/UHFB).

8. The switch according to claim 7, wherein the high-performance or ultra high-performance concrete contains fibers, particularly steel fibers and/or plastic fibers and/or glass fibers and/or carbon fibers.

9. A method for transporting and installing a switch according to claim 1, wherein the following steps are carried out:

completely preassembling a large switch component of switch segments such as the crossing area and a switch end part and of all components such as rails, check rails, crossing and mounting material on divided longitudinal sleepers that are connected with flexurally rigid connecting devices, said large switch component comprising a plurality of sleepers having hinges oriented and installed in such a way that the hinges are aligned along a straight line that can serve as a pivoting axis for folding up one switch side, carrying out a quality check and an acceptance of the large switch component removing part of bolts of the connecting device folding over a movable part of the large switch component securing the movable part loading and transporting the large switch component to an installation site unfolding the movable part of the large switch component back into an original position of the moveable part installing and tightening the bolts.

10. The method for transporting a large switch component according to claim 9, wherein the large switch component is in the folded state positioned on a standard car in such a way that a center of gravity of a load lies within a permissible range around a center of the car, wherein the load exceeds the permissible clearance gauge for a respective track section on a non-folded side of the switch.

11. The method for transporting a large switch component according to claim 9, wherein the large switch component is in the folded state positioned on a standard car in such a way that a normal clearance gauge is not exceeded, wherein a center of gravity of a load is shifted into a permissible range around the center of the car with the aid of counterweights placed on a non-folded side of the large switch component.

* * * * *